United States Patent [19]

Klötzer et al.

[11] 3,957,488

[45] May 18, 1976

[54] PHOTOGRAPHIC EMULSION CONTAINING UNFOGGED, HETERODISPERSE LAYERED SILVER HALIDE GRAINS HAVING A PRODOMINANTLY BROMIDE CORE AND TOTAL CHLORIDE CONTENT LESS THAN 30 MOLE PERCENT

[75] Inventors: Sieghart Klötzer; Erik Moisar, both of Cologne, Germany

[73] Assignee: AGFA-Gevaert, A.G., Leverkusen, Germany

[22] Filed: June 24, 1974

[21] Appl. No.: 482,437

[30] Foreign Application Priority Data

June 28, 1973 Germany ..... 2332802

[52] U.S. Cl. ..... 96/64; 96/94 R

[51] Int. Cl.[2] ..... G03C 1/02; G03C 5/24

[58] Field of Search ..... 96/94 R, 114.7, 107, 96/108, 64

[56] References Cited

UNITED STATES PATENTS

| | | | |
|---|---|---|---|
| 2,497,875 | 2/1950 | Fallesen | 96/64 |
| 2,592,250 | 4/1952 | Davey et al. | 96/114.7 |
| 3,206,313 | 9/1965 | Porter et al. | 96/108 |
| 3,501,305 | 3/1970 | Illingsworth | 96/107 |
| 3,761,266 | 9/1973 | Milton | 96/107 |

*Primary Examiner*—Won H. Louie, Jr.

*Attorney, Agent, or Firm*—Connolly and Hutz

[57] ABSTRACT

A photographic material for producing direct-positive photographic images with at least one silver halide emulsion layer containing unfogged heterodisperse silver halide grains with a core which consists predominantly of silver bromide and a localised phase with a high silver chloride content of at least 20 mols-%, the total concentration of silver chloride, based on the total silver halide content of the grain, is less than 30 mols-%, and at least 10% by weight of the silver halide grains have a diameter which deviates by at least 40% from the average grain diameter in which the silver halide grains are not or only slightly chemically sensitised on the surface.

6 Claims, No Drawings

PHOTOGRAPHIC EMULSION CONTAINING UNFOGGED, HETERODISPERSE LAYERED SILVER HALIDE GRAINS HAVING A PRODOMINANTLY BROMIDE CORE AND TOTAL CHLORIDE CONTENT LESS THAN 30 MOLE PERCENT

This invention relates to a photographic material for producing direct-positive photographic images which contains at least one unfogged silver halide emulsion layer and to a process for making direct-positive photographic images by fogging development.

In order to produce direct-positive photographic images, it is customary to use silver halide emulsions which have been fogged on the surface. The developable fog is then destroyed upon exposure at the exposed areas but remains intact at the non-lightstruck areas so that a direct-positive image is subsequently obtained by development. The sensitivity of fogged direct-positive silver halide emulsions to light depends on how rapidly the developable fog nuclei on the surface of the silver halide grains are destroyed by imagewise exposure to light. This in turn depends on the size and number of fog nuclei. If these are too large, the sensitivity to light is too low. The extent to which the light-sensitivity of such direct positive silver halide emulsions can be increased by optimizing the size of the fog nuclei is, however, limited because a relatively high degree of fogging is required to obtain a sufficiently high density in the direct-positive silver image and because relatively small fog nuclei are extremely sensitive to oxidation so that silver halide emulsions which are fogged with such small nuclei are not sufficiently stable upon storage. Fogged direct-positive silver halide emulsions are therefore of limited utility.

Silver halide emulsion layers which have not been fogged and in which the sensitivity in the interior of the grain is substantially higher than on the surface have also been described for producing direct-positive photographic images. Exposed materials of this kind are developed under conditions which cause fogging, mainly in the areas which have not been struck by light, so that a direct-positive silver image is obtained. The required fogging of layers which have been exposed imagewise is achieved either by developing with a developer which causes so-called air fogging in the presence of oxygen or by carrying out a process of selective fogging by diffuse exposure to light or treatment with a fogging agent either before or during development. Although the sensitivity to light obtained by using such unfogged direct-positive silver halide emulsions is relatively high compared with that obtained with fogged direct-positive emulsions, these unfogged emulsions are unsatisfactory in that a relatively high fog is produced also in the exposed areas so that the direct positive images obtained have an interfering background and relatively little differentiation between the areas of highest density and the areas of lowest density.

A certain improvement in this respect can be obtained with the unfogged direct-positive silver halide emulsions described in U.S. Pat. No. 3,761,266 but even these emulsions do not meet the requirements as regards sensitivity to light and whiteness of the image background. Moreover, these emulsions require a certain amount of chemical sensitization of the surface. This must be carried out under accurately controlled conditions in order to ensure that the surface will not be excessively chemically sensitized. This again has the disadvantage that reproducible preparation of such emulsions is possible only at considerable expense.

It is among the objects of the present invention to provide direct-positive photographic materials containing at least one unfogged direct-positive silver halide emulsion layer which has a high sensitivity to light, yields direct-positive images with very pure image whites and can easily be prepared in a reproducible manner.

We now have found a direct positive photographic material containing at least one unfogged heterodisperse silver halide emulsion in which the silver halide grains have a layered grain structure in which the silver halide grains of the silver halide emulsion contain a core which consists mainly of silver bromide and a locally restricted phase which has a silver chloride content of at least 20 mols-% but the total concentration of silver chloride, based on the total silver halide content of the grain, is not more than 30 mols-%.

The total silver chloride content based on the total silver halide of the grain is preferably between 5 and 30 mols-%, more particularly between 7,5 and 20 mols-%.

The remaining silver halide of the silver halide grains of the emulsion according to the invention consists of silver bromide or mixtures of silver bromide and silver iodide.

The locality of the phase with the high silver chloride content in the silver halide grain is not critical but is preferably arranged as an intermediate layer within the silver halide grain although it may also form an outer shell or envelope. The transition from the phase with the high silver chloride content to the layers of other silver halide compositions may form a sharp phase boundary or be continuous. Silver halide grains with a sharp phase boundary or short transition zone between the silver chloride-rich phase and silver bromide-rich zone are also suitable although emulsions with grains in which the transition between phases of differing halide compositions is more or less continuous are preferred. The silver halide grains of the emulsion according to the invention, however, preferably contain a phase which is free from AgCl. The core consists predominantly of silver bromide, preferably to an extent of at least 50 mols-%. Cores which contain at least 80 mols-% of AgBr are particularly suitable.

The unfogged direct positive silver halide emulsions used for the material according to the invention are of the kind which substantially form only a latent image in the interior of the grain when exposed to light, i.e. they are emulsions with substantially higher internal sensitivity than surface sensitivity.

The emulsions used according to the invention should therefore not be chemically sensitised on the surface or only chemically sensitised to a very slight extent. When samples of the exposed material according to the invention are developed with a surface developer of the following composition:

| | |
|---|---|
| p-hydroxyphenyl glycine | 10 g |
| sodium carbonate (cryst.) | 100 g |
| water up to 1000 ml | |

they should preferably not give rise to a silver image or only to one of very low density whereas with an internal developer of the following composition:

| | |
|---|---|
| hydroquinone | 15 g |
| monomethyl-p-aminophenol sulfate | 15 g |

-continued

| | |
|---|---|
| sodium sulfite (anhydrous) | 50 g |
| potassium bromide | 10 g |
| sodium hydroxide | 25 g |
| sodium thiosulfate (cryst.) | 20 g |
| water up to 1000 ml | |

they should give rise to a silver image of sufficient density. In any case the photographic material according to the invention when exposed stepwise for 1/100th to 1 second and developed for 3 minutes at 20°C in the internal grain developer described above should reach a maximum density which is at least three times but preferably at least five times greater than that obtained when developing a similarly exposed material (development time 4 minutes at 20°C) in the surface developer described above.

The internal grain sensitivity of the emulsions is due to the properties of the phase interface or phase transitions between AgCl-rich phase and AgBr-rich phase. The phase boundaries or phase transitions have to be considered as active centers for the deposition of photolytic silver. The high sensitivity to light of the emulsion according to the invention, on the other hand, does not depend on inclusions of foreign materials acting as electron traps.

The silver halide emulsions used according to the invention are heterodisperse emulsions with a wide grain size distribution. At least 10 % and preferably at least 20 % by weight of the silver halide grains should have a diameter which deviates by at least 40 % from the average grain diameter. The form of the silver halide grains is substantially irregular.

The absolute value of the average grain size may vary within wide limits. Depending on the purpose for which the photographic materials is intended, both fine grain heterodisperse silver halide emulsions with an average diameter of less than 0.5 μm, preferably less than 0.3 μm and coarse grain heterodisperse emulsions with average grain sizes of between 0.5 and 4 μm may be used.

Preparation of silver halide emulsions with a layered grain structure is relatively problem-free in the case of regular and homodisperse emulsions. Reference may be made e. g. to British Patent Specification No. 1,027,146 or to the publication by E. MOISAR and S. WAGNER in "Berichte der Bunsengesellschaft fur physikalische Chemie" 67 (1963) pages 356– 359. In the case of heterodisperse silver halide emulsions, however, the preparation of emulsions with a layered grain structure gives rise to considerable difficulties. Within the scope of this invention it has now been found that heterodisperse, irregular silver halide emulsions with a layered grain structure can be prepared particularly easily by the following process:

In a first stage of the process, the silver bromide-rich cores are produced by adding an aqueous silver salt solution, in particular a silver nitrate solution, to a gelatine-containing solution of the other precipitation component, preferably a solution of potassium bromide. Twin crystals with (1,1,1)-surfaces are thereby formed. The precipitation components used are preferably alkali metal bromides or iodobromide solutions. The desired average grain size and grain size distribution of the nuclei can be modified in known manner by using an excess of halide or by adjusting the conditions under which physical ripening is carried out, such as the temperature and time. The silver halide emulsion used for the nuclei may also contain a small proportion of silver chloride.

In the second stage of the process, a silver chloride-rich phase is applied to the silver bromide-rich core. This can be performed e. g. by adding aqueous solutions of silver nitrate and of alkali metal chloride to the core emulsion by a double jet process. Alternatively a fine-grained silver chloride gelatine emulsion may be added to the original core emulsion to bring about accretion of the silver chloride-rich phase by a process of dissolving and reprecipitation. In both variations of the process, a silver chloride-rich phase grows on the (1,1,1)-surfaces of the silver bromide-rich core emulsion.

Application of a silver halide layer which has a different halide composition to the resulting emulsion which now has an external silver chloride-rich layer can be achieved most simply by precipitation. This other silver halide layer is preferably also rich in silver bromide and in particular contains at least 90 mols-% of silver bromide.

The emulsion prepared in this way may be used according to the invention. If desired, additional shells of silver halide may, of course, be precipitated onto the grains of this emulsion. The structure of the silver halide grain is largely determined by the requirements in each individual case, which depend on the purpose for which the material is to be used. Moreover, the shell structure and arrangement of the shells are also capable of substantial modifications.

The usual hydrophilic film-forming agents may be used as protective colloids or binders for the silver halide emulsion layer, e. g. proteins, in particular gelatin, alginic acid or its derivatives such as esters, amides or salts, cellulose derivatives such as carboxymethyl cellulose and cellulose sulfates, starches or their derivatives or hydrophilic synthetic binders such as polyvinyl alcohol, partly saponified polyvinyl acetate, polyvinyl pyrrolidone and the like. Mixed with the hydrophilic binders, the layers may also contain solutions or dispersions of other synthetic binders such as homopolymers or copolymers of acrylic or methacrylic acid or their derivatives such as esters, amides or nitriles or vinyl polymers such as vinyl esters or vinyl ethers.

The usual supports may be used for the emulsion layer e. g. supports of cellulose esters such as cellulose acetate or cellulose acetobutyrate, or polyesters, in particular polyethylene terephthalat or polycarbonates, particularly those based on bis-phenylolpropane. Paper supports are also suitable, and these may contain water-impermeable polyolefine layers, e.g. of polyethylene or polypropylene; glass or metal supports may also be used.

The silver halide emulsions to be used according to the invention may contain the usual emulsion additive provided that the surface sensitivity is kept as low as possible.

The emulsions may contain the usual stabilisers, e. g. homopolar or salt-type compounds of mercury which contain aromatic or heterocyclic rings, simple mercury salts, sulfonium mercury double salts and other mercury compounds. Azaindenes are also suitable stabilisers, particularly tetra- or penta-azaindenes and especially those which are substituted with hydroxyl or amino groups. Compounds of this kind have been described in the article by BIRR, Z. WISS. Phot 47 (1962), pages 2 — 58. Other suitable stabilisers include heterocyclic mercapto compounds, e. g. quaternary benzothiazole derivatives, benzotriazole and the like.

The emulsions may also be spectrally sensitised, for example with the usual monomethine or polymethine dyes such as acid or basic cyanines, hemicyanines, streptocyanines, merocyanines, oxonoles, hemioxonoles, styryl dyes or the like or trinuclear or multinuclear methine dyes, for example rhodacyanines or neocyanines. Sensitisers of this kind have been described, for example, in the work by F. M. HAMER "The Cyanine Dyes and Related Compounds" (1964), Interscience Publishers, John Wiley and Sons, New York.

The photographic materials according to the invention are exposed imagewise in the usual manner and then developed under fogging conditions in so-called surface developers. By surface developers are meant development baths which do not contain any silver halide solvents and are therefore not capable of developing developable fog nuclei or latent image nuclei situated in the interior of the grain. Surface developers are capable only of reducing latent image nuclei or developable fog nuclei on the surface of the silver halide grain to a silver image. The usual photographic developers may be used for this purpose, for example developers of the p-phenylene diamine series.

For developing the photographic materials according to the invention by color-forming development processes, the usual color developers may be used, in particular those of the p-phenylene diamine series. Mixtures of various developing agents may, of course, be used for processing the exposed materials.

The developing agents may be added either to the aqueous development bath or to the photographic material itself, e. g. to the silver halide emulsion layer or an adjacent layer. If the developing agents are in a layer of the photographic material, then a so-called activator bath is used for development. This bath contains mainly alkali to adjust the bath to the required pH for development and optionally also additives which promote or control development. After development, the materials are fixed and washed in the usual manner.

As already indicated above, the photographic materials according to the invention which contain at least one unfogged direct positive silver halide emulsion layer are developed under fogging conditions after exposure. This development may be carried out by known methods, for example as described in U.S. Pat. No. 3,761,266. Furthermore, developers of a certain composition which produce a so-called air fog in the presence of atmospheric oxygen may be used. Developers of this kind have been described e. g. in German Patent Specification No. 850,383 and in U.S. Pat. No. 2,497,875. Fogging may also be achieved by diffuse exposure to light, e.g. flashlight exposure immediately before or during development. Processes of this kind have been described e. g. in German Patent Specification No. 854,888, U.S. Pat. Nos. 2,456,953 and 2,592,298 and British Patent Specification Nos. 1,150,553; 1,151,363; 1,195,387; 1,195,838 and 1,187,029.

According to a third method, fogging may be carried out by treating the exposed layer with a reducing agent before or during development. Suitable fogging agents are in particular hydrazine or substituted hydrazines such as alkyl or aryl hydrazines, hydrazinocarboxylic acids, acylated hydrazines, alkyl sulfonamidoaryl hydrazines, naphthyl hydrazine sulfonic acids and other hydrazine derivatives. Reference may be made to U.S. Pat. Nos. 2,563,785; 2,588,982; 2,604,400; 2,618,656; 2,663,732; 2,675,318; 2,685,514; 3,227,552 or 3,565,620 or to British Patent Specification No. 1,269,640.

Other fogging agents which may be used alone or together with hydrazines are quaternary ammonium salts, in particular cyclic quaternary ammonium salts such as those described in U.S. Pat. No. 3,615,615 and heterocyclic quaternary salts according to U.S. Pat. Nos. 3,737,738 and 3,719,494.

The fogging agents like the developing agents may be used either in one of the layers of the photographic material or in the development bath or the exposed layers may be treated with an aqueous solution of the fogging agent before development.

The concentration of the fogging compound used may vary within wide limits. It depends on the desired effect, the activity of the fogging agent and the nature of the unfogged direct positive silver halide emulsion. The optimum concentration for any given purpose can easily be determined by a few simple tests.

The developer may also contain the usual additives conventional for photographic developers such as antioxidants, water softeners, stabilisers, particularly those of the benzotriazole series or organic and in particular heterocyclic mercapto compounds, and development accelerators of the usual kind, in particular derivatives of polyalkylene oxides or quaternary ammonium compounds.

In some cases it may be advantageous if compounds which liberate iodide ions in the photographic process are added to the photographic material or to one of the treatment baths. Reference may be made to British Patent Specification Nos. 1,151,363; 1,187,029 or 1,195,837.

The material according to the invention may also contain halogen acceptors in known manner, in particular those which are relatively difficult to reduce but relatively easy to oxidise.

The process according to this invention may be used both for producing black and white photographic images and for producing colored photographic images. Thus for example depending on the gradation of the silver halide emulsion layer, the photographic material may be used for phototechnical purposes if it has a steep gradation or for producing black and white continuous-tone images or X-ray films if it has a medium or flat gradation. Colored photographic direct positive images may be produced, for example, according to the known principle of color-forming development in the presence of color couplers which react with the oxidation product of color-forming p-phenylene diamine developers to form dyes. The color couplers may be added to the direct positive, unfogged silver halide emulsion layers. Alternatively the color coupler can be present in the developer according to the so-called developing-in-process. The incorporation of color couplers into the emulsion layers may be carried out by the usual methods, for example water-soluble color couplers which contain one or more sulfo or carboxyl groups in form of the free acid or the salt may be added to the casting solution for the emulsion from an aqueous solution, if desired in the presence of alkali. Color couplers which are insoluble in water or insufficiently soluble in water are added as solutions in a suitable high-boiling, oil-forming or low-boiling organic solvent or solvent mixture which is miscible or immiscible with water. This solution may be dispersed in an aqueous solution of a protective colloid, optionally in the presence of a surface-active agent.

When using multi-layers color photographic materials with a transparent support, this invention may also be applied to the production of direct positive transparent photographic color images. The black and white development and uniform intermediate exposure to light required for the usual reversal processes are then unnecessary.

The material according to the invention may also be used in known manner for the silver dye bleaching process. In this case, negative images of the original are obtained because reversal again takes place at the stage of color bleaching.

This invention may be used particularly advantageously for instant color processes or color transfer processes in known manner. In these processes, the dyes for the partial color images diffuse into an image receiving layer where they become firmly fixed or the color couplers diffuse into the image receiving layer where they are converted into the image dye after the usual color-forming development.

The light-sensitive element generally consists of three light-sensitive silver halide emulsion layers, each of which is associated with one color-forming system. By color-forming system is meant a compound representing a dye or dye precursor which is embedded in a diffusion-fast form in the given layer and when when developed in the presence of the alkaline processing paste splits off diffusible dyes, preferably dyes which contain acid groups, under the action of the oxidation products of photographic developers, which oxidation products are produced imagewise. A wide variety of chemical compounds is available for this purpose. Particularly suitable compounds are, for example, the diffusion-fast color-forming substances described in U.S. Pat. No. 3,628.952. These compounds split off diffusible dyes when they react with the oxidation products of black and white developers or color developers. Another suitable class of compounds has been described in British Patent Specification No. 904,364. The compounds mentioned there react with oxidised color developer to form diffusible dyes which generally belong to the class of azomethine dyes.

Another suitable color-forming system has been described in U.S. Pat. Nos. 3,443,939 and 3,443,940. In this system, diffusible dyes are split off by a reaction accompanied by ring closure which takes place under the action of oxidised developing agents. Color transfer processes and couplers used in such processes which may also be used in the present invention have also been described in U.S. Pat. Nos. 2,983,606; 3,087,817; 3,185,567; 3,227,550; 3,227,551; 3,227,552; 3,227,554; 3,253,915; 3,415,644; 3,415,645 and 3,415,646.

The light-sensitive materials used for the instant color process generally have the following layer arrangement:

blue-sensitive silver halide emulsion layer,
layer which releases yellow dye,
separating layer,
green-sensitised silver halide emulsion layer,
layer which releases magenta dye,
separating layer,
layer which releases cyan dye.

EXAMPLE 1 a. To prepare a heterodisperse starting emulsion, a solution of 690 g of $AgNO_3$ and 1300 ml of water is run into a solution of 600 g of KBr and 100 g of gelatine in 3000 ml of water at 35°C within 1 minute with stirring. Further 150 g of gelatine are added and dissolved within 15 minutes. The emulsion is cooled and solidified and freed from soluble alkali metal salts by washing it with water. The emulsion is then remelted and adjusted to pAg9.

The crystals of the resulting emulsion are irregular and have an average particle diameter of 0.5 $\mu$. 35 % of the crystals are outside the range of sizes of ±40 % of the average diameter, i.e. outside the range of 0.3 – 0.7$\mu$m.

b. Using a portion of the AgBr emulsion prepared according to 1 (a) as starting material, an AgCl envelope was precipitated on the original crystals by pAg-controlled double inflow of 3 N KCL and 3 N $AgNO_3$ solutions. The quantity of AgCl precipitated was 75 mol-%, based on the quantity of AgBr in the original emulsion.

c. AgBr was then precipitated on the AgCl envelope prepared according to 1 (b) by pAg-controlled double inflow of 3 N KBr and 3 N $AgNO_3$ solutions, the quantity of AgBr precipitated being 675 mols-% of the emulsion used as starting material.

The resulting heterodisperse emulsion contains irregular crystals with an average particle diameter of 0.85 $\mu$m which contain an AgCl layer in the interior, the proportion of AgCl based on the total silver halide being 8.8 %.

The emulsion was solidified, washed with water, remelted and adjusted to pAg 9 and then cast on a support of polyethylene terephthalate. It was exposed behind a grey wedge in the usual manner and then developed with a developer of the following composition:

| | |
|---|---|
| N-ethyl-N-hydroxyethyl-p-phenylene diamine | 10 g |
| sodium sulfite (anhydrous) | 2 g |
| trisodium phosphate (cryst.) | 40 g |
| sodium hydroxide | 5 g |
| benzimidazole | 0.05 g |
| acetyl phenyl hydrazide | 1 g |
| water up to 1000 ml | |

The developed material was fixed and washed in known manner. A direct positive stepped wedge was obtained and examined sensitometrically in the usual manner. The relative sensitivity ($E_{rel}$) was indicated as reciprocal value of the exposure which led to a density which was 0.1 density units below the level of maximum density ($D_{max}$), using E = 100 as reference value for the sensitivity, where E is the sensitivity of a comparison emulsion with an average grain size of 0.4$\mu$m obtained by converting an AgCl emulsion with excess KBr according to U.S. Pat. No. 2,592,250 under the same conditions of exposure and development.

The sensitometric properties of the comparison emulsion and of the emulsion according to the invention in this example are summarised below:

| | $E_{rel}$ | $D_{max}$ | $D_{min}$ | $\Delta D$ |
|---|---|---|---|---|
| Comparison emulsion | 100 | 1.04 | 0.80 | 0.24 |
| Emulsion according to the invention | 3200 | 0.62 | 0.07 | 0.55 |

The comparison shows convincingly the gain in sensitivity and in contrast (as indicated by the difference $D_{max}$ - $D_{min}$) and the significantly lower minimum density $D_{min}$ of the emulsion according to the invention.

The maximum density can easily be increased if desired by increasing the amount of silver halide applied without thereby increasing the excellent value for $D_{min}$.

EXAMPLE 2

The emulsion prepared according to Example 1(c) was used as a starting emulsion for a further precipitation step by pAg-controlled double inflow of 3N KBr and 3N $AgNO_3$ solution. A heterodisperse silver halide emulsion with irregular crystals having an average particle diameter of 1.4 μm was obtained in which the AgCl content based on the total halide content was 1.5 %.

After the usual processing, exposure and development as indicated in Example 1, a direct positive step wedge was obtained. Sensitometric interpretation gave the following resulsts, using the same comparison emulsion as in Example 1:

$E_{rel}$: 13000
$D_{max}$: 0.84
$D_{min}$: 0.08

EXAMPLE 3

AgBr/I was precipitated on the emulsion prepared according to Example 1(b) by pAg-controlled double inflow of a 3 N $AgNO_3$ solution and a solution which was 2.85 molar with respect to KBr and 0.15 molar with respect to KI. The resulting emulsion was heterodisperse and contained irregular crystals, and the AgCl content, based on the total halide content was 12.3 %.

After processing, exposure and development in known manner as described in Example 1, a direct positive step wedge was obtained. Sensitometric determination gave the following results using the same comparison emulsion as in example 1:

$E_{rel}$: 800
$D_{max}$: 0.95
$D_{min}$: 0.08

EXAMPLE 4

A heterodisperse emulsion with an AgCl intermediate layer was prepared according to Example 1 and AgBr was precipitated as an envelope as described in Example 2. The emulsion was solidified, washed and adjusted to pAg 9 after remelting in the usual manner. It was then cast without optical sensitiser (sample O) and after optical sensitisation with the dye

I

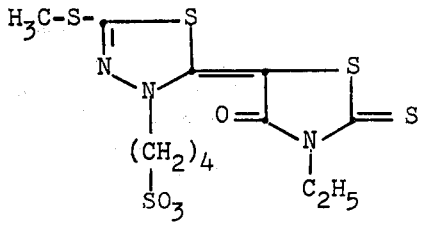

After exposure behind a blue filter and processing as described in Example 1(c), the sensitometric data shown in the following table were obtained, the sensitivity figure $E_{rel,bl.}$ obtained on exposure to blue light being obtained with reference to $E_{rel}$ = 100 used in Example 1(c) which is the standard sensitivity of the comparison emulsion prepared according to the known art when exposed to white light.

| Additive | Quantity of sensitiser mg/mol AgX | $E_{rel,\,bl.}$ | $D_{max}$ | $D_{min}$ |
|---|---|---|---|---|
| 0 | — | 400 | 0.69 | 0.12 |
| I | 128 | 800 | 0.80 | 0.14 |

EXAMPLE 5

The procedure was the same as in Example 4 but the following sensitisers were added

II

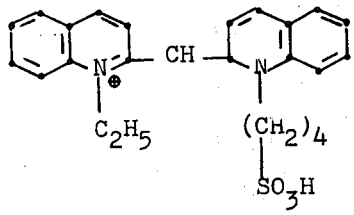

and

III

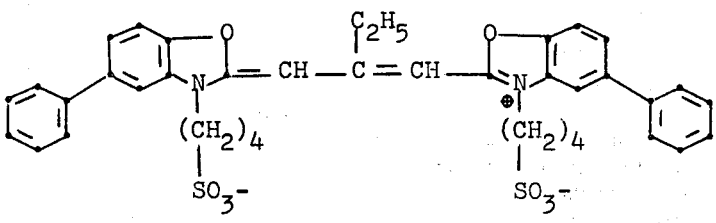

After exposure behind a green filter and processing as described in Example 1(c), the sensitometric data shown in the following table were obtained. The sensitivity values $E_{rel,gr.}$ obtained on exposure to green light are based on $E_{rel}$ = 100 used as standard in Example 1(c) which is the sensitivity of a comparison emulsion prepared according to the known art on exposure to white light.

| Additive | Quantity of sensitiser mg/mol AgX | $E_{rel,gr.}$ | $D_{max}$ | $D_{min}$ |
|---|---|---|---|---|
| 0 | — | 0 | 0.71 | 0.68 |
| II | 128 | 800 | 0.69 | 0.13 |
| III | 128 | 1600 | 0.73 | 0.11 |

EXAMPLE 6

The procedure was the same as in Example 4 but a red sensitizing dye of the following formula was added:

IV

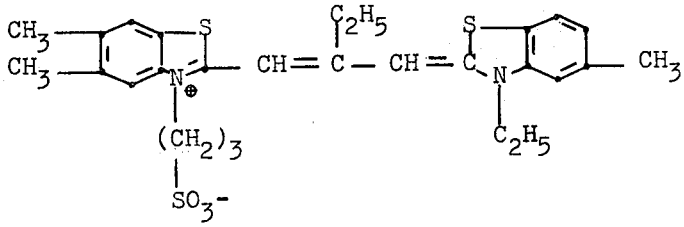

After exposure behind a red filter and processing as in Example 1(c), the sensitometric data shown in the following table were obtained. The sensitivity $E_{rel,red}$ obtained on exposure to red light is based on the standard $E_{rel}$ = 100 used in Example 1(c) which is the sensitivity of the comparison emulsion prepared according to the known art when exposed to white light.

| Additive | Quantity of sensitiser mg/mol of AgX | $E_{rel,red}$ | $D_{max}$ | $D_{min}$ |
|---|---|---|---|---|
| 0 | — | 0 | 0.65 | 0.64 |
| IV | 128 | 1600 | 0.57 | 0.11 |

EXAMPLE 7

A fine-grained silver chloride emulsion was added to a portion of the heterodisperse starting emulsion described in Example 1(a). The quantity of AgCl in the said silver chloride emulsion was 25 mols-%, based on the AgBr emulsion. In the course of physical ripening for 120 minutes at 60°C, a layer of AgCl was deposited on the irregular crystals of the AgBr emulsion as the result of solution and reprecipitation of the AgCl emulsion.

The emulsion was solidified, washed with water, remelted, adjusted to pAg 8 and cast on a support of polyethylene terephthalate. After processing as described in Example 1(c), the following sensitometric data were obtained, using the same comparison emulsion as in Example 1:

$E_{rel}$: 800
$D_{max}$: 0.73
$D_{min}$: 0.13

We claim:

1. A photographic material for producing direct positive photographic images with at least one silver halide emulsion layer containing unfogged silver halide grains, in which the silver halide grains have a layered grain structure wherein at least 10% of the silver halide grains of the emulsion have a grain diameter which deviates by at least 40% from the average grain diameter and are substantially not chemically sensitized on the surface, wherein the improvement comprises the silver halide grains of the silver halide emulsion contain a core which consists predominantly of silver bromide and a localised phase with a high silver chloride content of at least 20 mols-%, the total concentration of silver chloride, based on the total silver halide content of the grain, is less than 30 mols-%, and the silver halide grains are on the surface not or only to such an extent chemically sensitized that they are developable after exposure stepwise for 1/100 th to 1 second and developed for 3 minutes at 20°C in the internal developer of the following composition:

| | |
|---|---|
| hydroquinone | 15g |
| monomethyl-p-aminophenol sulfate | 15g |
| sodium sulfite (anhydrous) | 50g |
| potassium bromide | 10g |
| sodium hydroxide | 25g |

-continued

| | |
|---|---|
| sodium thiosulfate (cryst) | 20g |
| water up to 1000 ml | |

to reach a maximum density which is at least three times than that obtained when developing a similarly exposed material for 4 minutes at 20°C in the surface developer of the following composition:

| | |
|---|---|
| p-hydroxyphenyl glycine | 10g |
| sodium carbonate (cryst.) | 100g |
| water up to 1000 ml. | |

2. The photographic material of claim 1, wherein the total concentration of silver chloride, based on the total silver halide content of the grain, is less than 20 mols-%.

3. The photographic material of claim 1, wherein the silver halide grains of the emulsion are free of chemical sensitization on the surface.

4. The photographic material of claim 1, wherein the silver halide grains of the emulsion have an irregular crystal form.

5. The process for the production of direct positive photographic images comprising the steps of imagewise exposing a photographic material comprising at least one light sensitive silver halide emulsion layer which contains unfogged silver halide grains with a layered grain structure wherein at least 10% of the silver halide grains of the emulsion have a grain diameter which deviates by at least 40% from the average grain diameter and are substantially not chemically sensitized on the surface and fogging development of the exposed layer wherein the improvement comprises the silver halide grains of the emulsion contain a core which consists predominantly of silver bromide and a localised phase with a high silver chloride concentration, based on the total silver halide content of the grain, is less than 30 mols-%, and the silver halide grains are on the surface not or only to such an extent chemically sensitized that they are developable after exposure stepwise for 1/100 th to 1 second and developed for 3 minutes at 20°C in the internal developer of the following composition:

| | |
|---|---|
| hydroquinone | 15g |
| monomethyl-p-aminophenol sulfate | 15g |
| sodium sulfite (anhydrous) | 50g |
| potassium bromide | 10g |
| sodium hydroxide | 25g |
| sodium thiosulfate (cryst) | 20g |
| water up to 1000 ml | |

to reach a maximum density which is at least three times than that obtained when developing a similarly exposed material for 4 minutes at 20°C in the surface developer of the following composition

| | |
|---|---|
| p-hydroxyphenyl glycine | 10g |
| sodium carbonate (cryst.) | 100g |
| water up to 1000 ml. | |

6. The process of claim 5, wherein the silver halide grains of the emulsion are free of chemical sensitization on the surface.

* * * * *